US005619979A

United States Patent [19]

Ossege

[11] Patent Number: 5,619,979

[45] Date of Patent: Apr. 15, 1997

[54] CROSSBOW FOR THE SHOOTING OF ARROWS, BOLTS, HARPOONS OR FOR NARCOTICIZING PURPOSES

[75] Inventor: Johannes Ossege, Bad Iburg-Ostenfelde, Germany

[73] Assignee: DOHT GmbH, Lengerich, Germany

[21] Appl. No.: 368,800

[22] Filed: Jan. 4, 1995

[30] Foreign Application Priority Data

Jan. 7, 1994 [DE] Germany ..... 44 00 290.4

[51] Int. Cl.[6] ..... F41B 5/12

[52] U.S. Cl. ..... 124/25; 124/40

[58] Field of Search ..... 124/16, 25, 25.6, 124/26, 27, 28, 40, 87

[56] References Cited

U.S. PATENT DOCUMENTS

| | | | |
|---|---|---|---|
| 3,028,851 | 4/1962 | Drake | 124/25 X |
| 3,874,359 | 4/1975 | Cesin | 124/16 |
| 4,649,892 | 3/1987 | Bozek | 124/25 |
| 4,693,228 | 9/1987 | Simonds et al. | 124/25 |
| 4,719,897 | 1/1988 | Gaudreau | 124/25 |
| 4,721,092 | 1/1988 | Waiser | 124/25 X |
| 4,827,894 | 5/1989 | Schallberger | 124/25 |
| 4,877,008 | 10/1989 | Troubridge | 124/25 |
| 4,942,861 | 7/1990 | Bozek | 124/25 |
| 5,215,069 | 6/1993 | Liu | 124/25 |

*Primary Examiner*—John A. Ricci
*Attorney, Agent, or Firm*—Keck, Mahin & Cate

[57] ABSTRACT

The invention relates to a crossbow for the shooting of arrows, bolts, harpoons or for narcoticizing purposes with rigid propelling arms, wherein a spring assembly centrally arranged in the base frame is tensioned by tensioning members and wherein the triggering device is indirectly released with a low expenditure of force by a bolt pre-stressed against a spring force.

16 Claims, 2 Drawing Sheets

CROSSBOW FOR THE SHOOTING OF ARROWS, BOLTS, HARPOONS OR FOR NARCOTICIZING PURPOSES

FIELD OF THE INVENTION

The present invention concerns a crossbow for the shooting of arrows, bolts, harpoons or for narcoticizing purposes, which has a shaft with a support for the projectile to be shot, and wherein the string is tensioned against a spring force by means of two rigid propelling arms articulated on the base frame.

PRIOR ART

Such a crossbow is known. The two propelling arms are each tensioned against a spring. To reach various target distances, various springs are used. In this known crossbow, there is the great drawback that different prestressings may occur because of the individual spring assigned to each propelling arm, which results in an inaccurate shot. The two springs constitute, moreover, a high mass inertia, and lead to an increased weight of the weapon. The handling is very clumsy and has great disadvantages because of the high weight, in particular when one is hunting. To make it possible to shoot over a long distance and with accuracy, a very high spring tension is necessary, so that high stresses act on the triggering mechanism. In actuating the trigger, relatively high forces are necessary, so that a certain movement of the crossbow cannot be avoided at the time of the shot. This then inevitably results in an inaccurate shot.

OBJECT OF THE INVENTION

It is the object of the present invention to load the two propelling arms with a completely equal force, using an arrangement in which the trigger is at the same time able to be actuated as lightly as possible to obtain an accurate shot.

SUMMARY OF THE INVENTION

To obtain these advantages, the present invention provides a crossbow for the shooting of arrows, bolts, harpoons or for narcoticizing purposes, which has a base frame; a shaft with a support for the projectile to be shot; and the string tensioned against a spring force by means of two rigid propelling arms articulated on the base frame, wherein the tensioning spring is mounted in the base frame under the support for the projectile and is connected to the two propelling arms by means of deflected elements.

Only one spring element or spring system is arranged centrally in the weapon, so that it is possible for the structure of the whole crossbow to be very small and light. The spring force acts evenly on the two propelling arms via the deflected elements, so that the crossbow does not move laterally during shooting.

To allow the spring force to be distributed completely evenly over the two propelling arms, the deflected elements may be adjustable in length by means known per se.

The tensioning of the propelling arms against the force of the spring or of the spring assembly may be obtained by means of tensioning members articulated on the base frame on both sides and which are provided with elements, for example hooks, engaging behind the propelling arms. The hooks of the tensioning members serving as long lever arms, are pushed behind the propelling arms so that the propelling arms, and hence the string, can be tensioned with a relatively low expenditure of force.

The tensioning members are preferably mounted on the base frame with a universal joint. Thus the propelling arms can be folded down in a simple manner and then serve as a support during the shooting.

The present invention may moreover make provision for the tensioning members to be connectable to each other by arresting means. With hooks engaging behind the propelling arms, the crossbow can thus be secured in a very simple manner. With propelling arms applied in this way, the crossbow is very narrow and can then be carried far more easily and can also be transported.

In this connection it has proved to be expedient for the arresting means to consist of catches which are latched together and engage in each other under a spring force.

If the deflected elements, such as cords, are carried over cam segments, it is possible to achieve an extremely high spring force with the different transmission ratio obtained thereby during the tensioning, with a relatively small bodily force.

The triggering device may consist of a tensioning bolt which is provided at one end with a projection, for example in the form of a projecting edge or with a catch, below which a displaceable securing element engages in the tensioned position also under the action of a spring causing the trigger or a component connected thereto to be displaced at the same time, also under spring action, under the tensioning bolt or under a projection attached to the tensioning bolt. An indirectly operating trigger is created by means of these measures. The high force necessary for releasing the shot is already produced by the prestressing of the tensioning bolt. On actuation of the trigger, the tensioning bolt is released with a very low expenditure of force, whereby the trigger releases the string holder and the shot is thus triggered. The securing element automatically snaps into the secured position to prevent any unintended shot. If the tensioning bolt is displaced against the spring force, the trigger automatically engages in the tensioning position, and the securing element in the secured position. It is only when the latter has been displaced that the crossbow is unlocked and ready for shooting.

The released tensioning bolt may moreover be connected directly or indirectly under the spring force to the arresting means of the string holder or may pass into contact therewith. After the tensioning bolt has moved under the force of the prestressed spring by the actuation of the trigger, the arresting of the string holder is released, so that the shot is fired.

If during the actuation of the trigger the tensioning bolt again displaces the securing element directly or indirectly into the secured position, the weapon is automatically secured again immediately after the tensioning bolt has been tensioned.

On the displaceable securing element and on the tensioning bolt there may be provided catches, notches or the like which in the secured position of the securing element are rigidly connected to each other. If the trigger is inadvertently actuated without the displacement of the securing element, that is to say if the crossbow has not been unlocked, the catches or notches engage in each other so that the shot cannot fire. It is then also not possible to unlock the crossbow otherwise the shot would then go off. It is only after the tensioning bolt has again been tensioned that the securing element can be displaced against the spring force to prepare the crossbow for shooting.

In a crossbow with a sight, the sight may be arranged on a lever which extends over the whole length of the crossbow and is mounted for pivoting at the rear, and for being adjustable in height at the front. By means of this long lever, it is possible to set the sight accurately in a very simple manner.

Finally, a scale may be attached to the height adjustment, to make it possible in this way to set the correct sight adjustment easily and accurately for given target distances.

BRIEF DESCRIPTION OF THE DRAWINGS

The invention that is characterized in the claims will be explained below in greater detail with reference to an exemplary embodiment, with reference to the accompanying drawings, in which:

DETAILED DESCRIPTION OF THE PREFERRED EMBODIMENT

Figure 1:
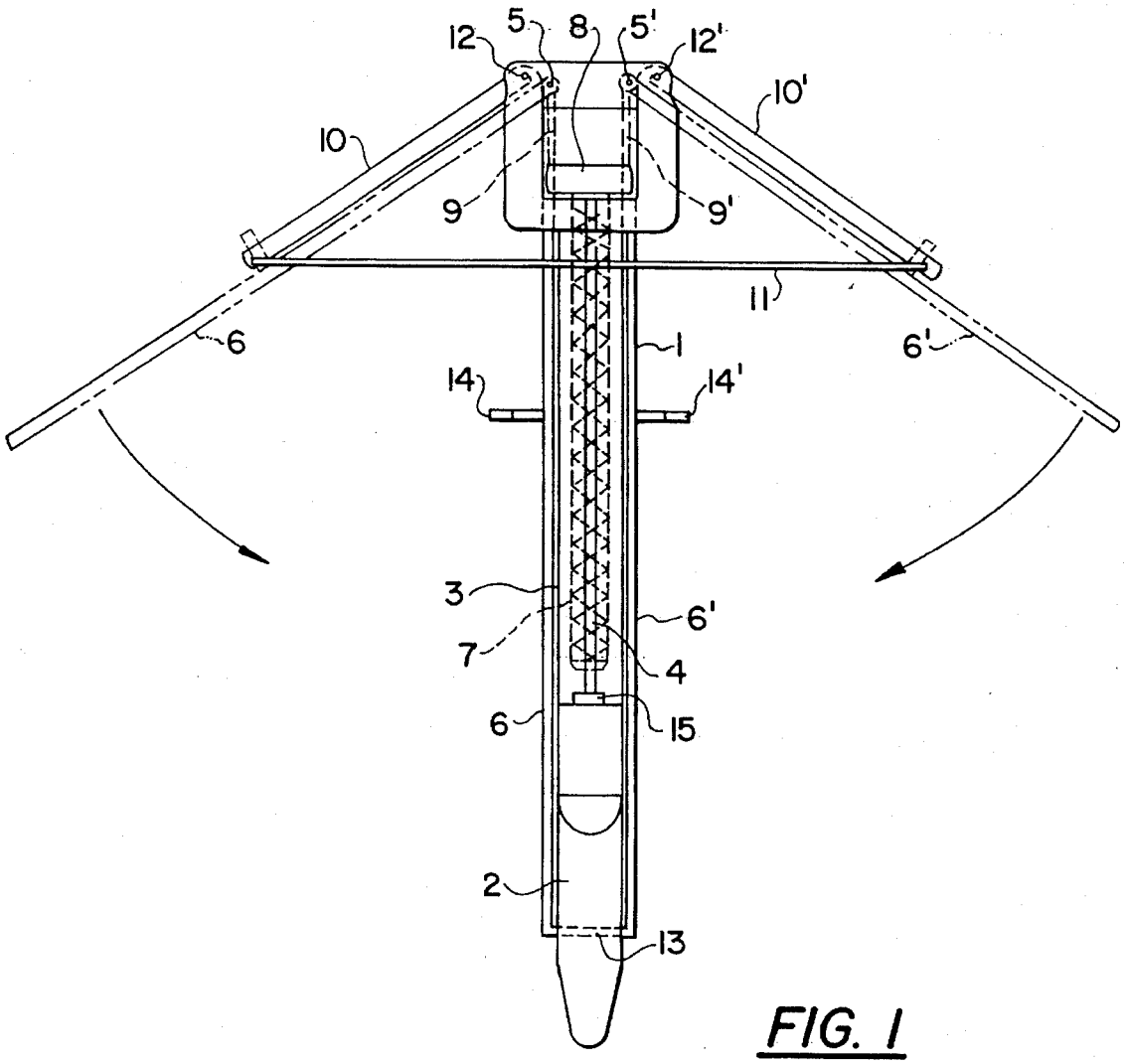
FIG. 1 shows a top plan view of a crossbow in accordance with the invention.

The crossbow 1 consists in essence of the shaft 2, the base frame 3, as well as of the projectile support 4. Tensioning members 6, 6' are mounted on both sides on the base frame 3 at points 5, 5', with universal joints.

In the base frame 3, provision is made below the projectile support 4 for a spring assembly 7 which is connected to the propelling arms 10, 10' via a pivotable component 8 and via cords 9, 9', the string 11 being secured between the ends of the propelling arms 10, 10'. The springs assembly 7 may be a stack of cup springs or plate springs. The length of the cords 9, 9' can be adjusted by means not shown herein. It is also possible to mount the pivotable component 8 with a universal joint, whereby the spring force of the spring assembly 7 would automatically be evenly distributed over both propelling arms 10, 10' in the direction of arrow 2. The cords 9, 9' are carried over cam segments 12, 12' so as to obtain a transmission leverage for the easier tensioning of the spring assembly 7 as the propelling arms 10, 10' are being tensioned. At the same time, the movement and hence the speed, of the propelling arms 10, 10' can be controlled by determining the shape of the cam segments 12, 12'.

For tensioning the propelling arms 10, 10', the arresting means 13, not here described in greater detail, which may consist of catches which engage in each other under a spring force, are released and swung forward until the hooks 14, 14' engage behind the propelling arms 10, 10'. Subsequently the tensioning members 6, 6' are pivoted with the exertion of force against the spring force of the spring assembly 7 until the string 11 can be placed into the string holder 15. The tensioning members 6, 6' can then be arrested above the shaft 2, whereby the propelling arms 10, 10' are held fast and the crossbow 1 is thus secured, even when the propelling arms 10, 10' are tensioned. Since in this position the propelling arms 10, 10' bear on the base frame 3, the crossbow 1 as a whole is then very narrow, which facilitates a simple carriage or packing. When the tensioning members 6, 6' are brought into their position shown in FIG. 2, the hooks 14, 14' no longer engage behind the propelling arms 10, 10', so that the crossbow is then ready for shooting.

A lever 16, arranged on the base frame 3 for pivoting round the axis 17, is adjustable in height at the front in a slot 19 by means of a clamping screw 18. Next to the slot 19 is a scale 20, to permit an exact setting of the sight 21 fitted on the lever 16.

The triggering device 22 consists of a tensioning bolt 23 which is displaced in the direction of arrow 26 against a spring acting in the direction of arrow 25, by means of an actuating lever 24 so as to tension the triggering device 22 in this way. In this action, the safety element 27 is displaced to bring its catch 29 under the catch 30 on the tensioning bolt 23, by means of a spring acting in the direction of arrow 28. At the same time, the component 32 connected to the trigger 31 is displaced under the tensioning bolt 23 by a spring which acts in the direction of arrow 33.

For freeing the triggering device 22, the safety element 27 is displaced by the actuating lever 34 against the force of the above mentioned spring, until the actuating lever 34 enters the upward limb of the angular slot to reach into the position 35 and be secured therein. If the trigger 31 is then actuated, which only requires a very small expenditure of force when the triggering device 22 is unlocked, the tensioning bolt 23 is released and is impelled under the spring force in the direction of arrow 25 to strike the lever 36, whereby it releases the arresting means 37 of the string holder 15 that is pivoted by a spring acting in the direction of arrow 38, and thereby releases the string 11. At the same time an element 39, which is connected to the tensioning bolt 23, presses on the actuating lever 34 and pushes the latter out of its secured position 35, so that after the shot the safety element 27 is automatically displaced again under the spring force into the safety position.

If the trigger 31 is inadvertently actuated when the triggering device 22 has not been released, the tensioning bolt 23 is only displaced until the catches 29 and 30 engage in each other, without the tensioning bolt 23 touching the lever 36. It is then also not possible to release the shot by the displacement of the safety element 27 by means of the actuating lever 34, since the tensioning bolt 23 has first to be retensioned again. Only then can the crossbow 1 be unlocked again by the actuating lever 34.

Figure 2:
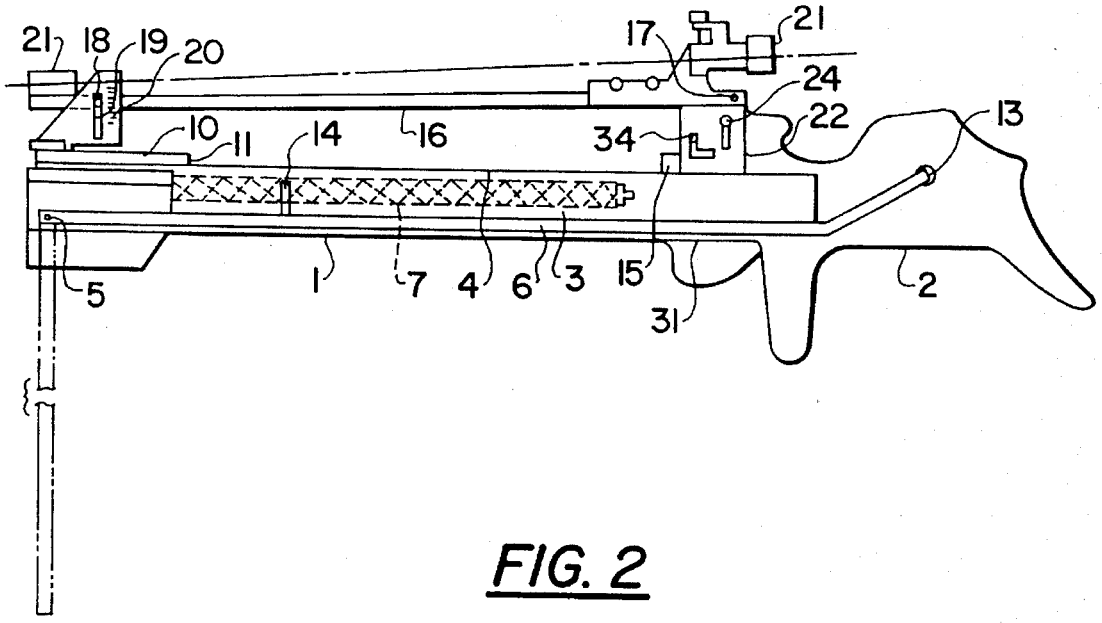
FIG. 2 is side view of a crossbow of FIG. 1.
Figure 3:
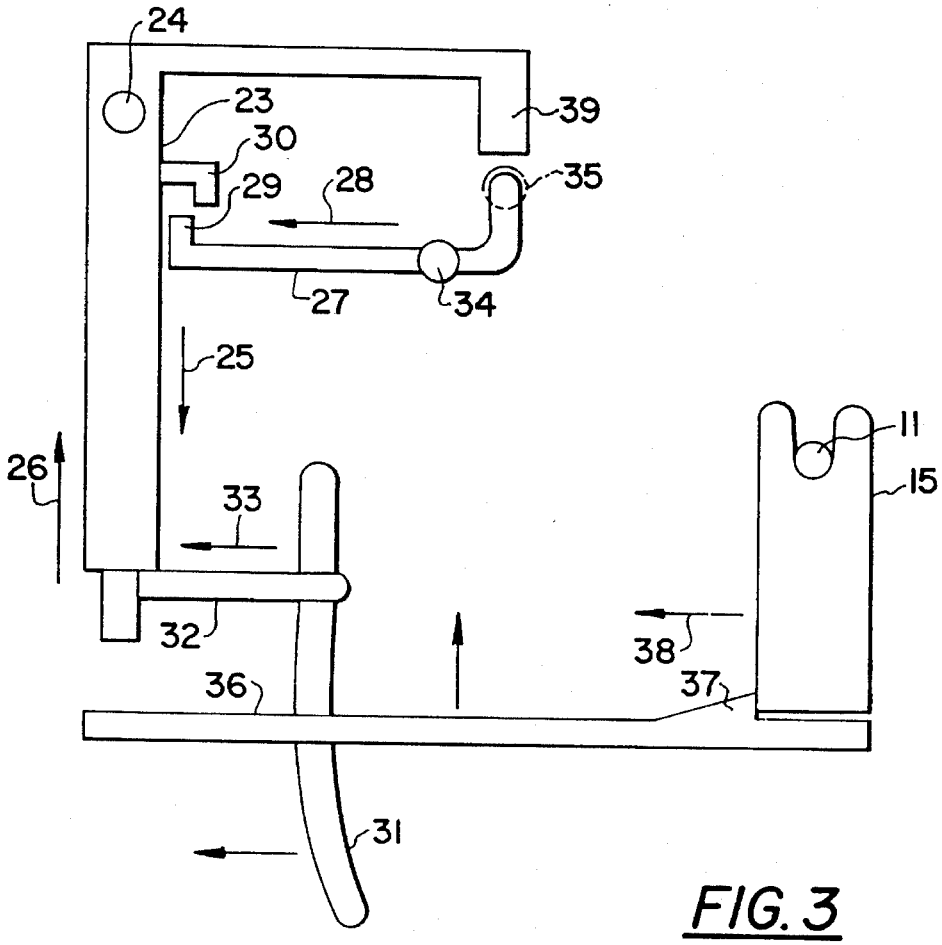
FIG. 3 shows a schematic diagram of the trigger mechanism of the crossbow in accordance with the invention.

For reliable aiming, the tensioning members 6, 6' can be swung down into the position drawn in dashes in FIG. 2, so as to be used as a support for the crossbow 1.

I claim:

1. In a crossbow for shooting any of arrows, bolts and harpoons or for narcoticizing purposes comprising:

a base frame;

a shaft with a support for a projectile to be shot;

two rigid propelling arms articulated on the base frame;

a string extending between ends of said propelling arms; and a spring assembly, including a tensioning spring, for applying a spring force against which said string is tensioned by said propelling arms;

the improvement wherein the tensioning spring is mounted in the base frame under the support for the projectile and is connected to the two propelling arms by deflected cords and wherein, on both sides of the base frame, respective tensioning members are articulated and provided with elements which engage behind the propelling arms.

2. A crossbow according to claim 1 wherein the deflected cords are adjustable in length.

3. A crossbow according to claim 1, wherein the deflected cords are connected to the spring assembly by a pivotable component.

4. A crossbow according to claim 1, wherein the deflected cords are carried over cam segments.

5. A crossbow according to claim 1, wherein said elements which engage behind the propelling arms are hooks.

6. A crossbow according to claim 1, wherein each of the tensioning members is mounted on the base frame by a universal joint.

7. A crossbow according to claim 1, wherein the tensioning members are connectable to each other by arresting means for arresting the tensioning members.

8. A crossbow according to claim 7, wherein the arresting means operate under a spring force.

9. A crossbow according to claim 1, and further comprising a triggering device consisting of a tensioning bolt displaceable against a spring force and provided at one end with a projection, below which a spring biased displaceable safety element engages in a tensioned position, wherein a trigger component of said triggering device is displaced, also under spring action, under one of the tensioning bolt and a projection attached to the tensioning bolt.

10. A crossbow according to claim 9, wherein said projection is in the form of a projecting edge or catch.

11. A crossbow according to claim 9 and further comprising a string holder for holding said string after it is tensioned and arresting means for arresting the string holder, wherein, when released, the tensioning bolt is connected, under a spring force, to the arresting means for arresting the string holder and passes into contact therewith.

12. A crossbow according to claim 9 wherein, when the trigger component is actuated, the tensioning bolt again displaces the safety element into a safety position.

13. A crossbow according to claim 9, wherein on the displaceable safety element and on the tensioning bolt are catches which, in a safety position of the safety element, engage in each other when the component is actuated.

14. A crossbow according to claim 1, and further comprising a sight and a lever on which said sight is arranged, said lever extending over the length of the crossbow, mounted at its rear, and mounted on means for adjusting its height at its front.

15. A crossbow according to claim 14, including a scale on the means for adjusting the height of the lever.

16. A crossbow according to claim 1, wherein said tensioning spring is a stack of cup springs or plate springs.

* * * * *